US009029704B2

(12) United States Patent
Jeroense et al.

(10) Patent No.: US 9,029,704 B2
(45) Date of Patent: May 12, 2015

(54) ELECTRIC POWER CABLE

(75) Inventors: Marc Jeroense, Karlskrona (SE); Claes Sonesson, Rödeby (SE); Johan Ekh, Västerås (SE)

(73) Assignee: ABB Technology AG, Zürich (CH)

( * ) Notice: Subject to any disclaimer, the term of this patent is extended or adjusted under 35 U.S.C. 154(b) by 750 days.

(21) Appl. No.: 12/602,218

(22) PCT Filed: May 29, 2008

(86) PCT No.: PCT/EP2008/056607

§ 371 (c)(1),
(2), (4) Date: Nov. 30, 2009

(87) PCT Pub. No.: WO2008/145691

PCT Pub. Date: Dec. 4, 2008

(65) Prior Publication Data

US 2010/0186988 A1 Jul. 29, 2010

(30) Foreign Application Priority Data

May 29, 2007 (EP) ..... 07109060

(51) Int. Cl.
*H01B 7/18* (2006.01)
*H01B 7/14* (2006.01)

(52) U.S. Cl.
CPC ..... *H01B 7/1885* (2013.01); *H01B 7/14* (2013.01)

(58) Field of Classification Search
USPC ..... 174/103, 102 D, 105 R
See application file for complete search history.

(56) References Cited

U.S. PATENT DOCUMENTS

| | | | | | |
|---|---|---|---|---|---|
| 3,607,487 | A * | 9/1971 | Biskeborn et al. | ..... | 156/47 |
| 3,638,306 | A * | 2/1972 | Padowicz | ..... | 29/825 |
| 4,112,247 | A * | 9/1978 | Dembiak et al. | ..... | 174/16.1 |
| 4,780,574 | A * | 10/1988 | Neuroth | ..... | 174/102 D |
| 6,242,692 | B1 * | 6/2001 | King | ..... | 174/36 |
| 2006/0076155 | A1 * | 4/2006 | Belli et al. | ..... | 174/102 SC |

FOREIGN PATENT DOCUMENTS

| | | | |
|---|---|---|---|
| DE | 1090734 | B | 10/1960 |
| DE | 29915252 | U1 | 4/2000 |
| EP | 0727790 | A | 8/1996 |
| GB | 1247715 | A | 9/1971 |
| GB | 1580089 | A | 11/1980 |

OTHER PUBLICATIONS

PCT/ISA/210—International Search Report—Nov. 25, 2008.
European Search Report—Oct. 23, 2007.
PCT/IPEA/409—International Preliminary Report on Patentability—Jul. 13, 2009.
PCT/ISA/237—Written Opinion of the International Search Authority—November 25, 2008.

* cited by examiner

*Primary Examiner* — Chau N Nguyen
(74) *Attorney, Agent, or Firm* — Dilworth & Barrese, LLP.

(57) ABSTRACT

An electric power sea cable including at least one cable core. The cable core includes an electric conductor, an electric insulation surrounding the conductor, and a protective sheath surrounding the electric insulation and acting as a water barrier. At least one outer layer surrounds the at least one cable core. The protective sheath is made of metal and the electrical power sea cable includes at least one friction reducing layer surrounding the at least one cable core and arranged inside of the at least one outer layer.

15 Claims, 4 Drawing Sheets

ELECTRIC POWER CABLE

CROSS-REFERENCE TO RELATED APPLICATIONS

This application claims priority to European patent application 07109060.9 filed 29 May 2007 and is the national phase under 35 U.S.C. §371 of PCT/EP2008/056607 filed 29 May 2008.

TECHNICAL FIELD

The present invention relates to an electric power sea cable, comprising at least one cable core, the at least one cable core comprises an electric conductor, an electric insulation surrounding the conductor, and a tubular protective sheath surrounding the electric insulation and acting as a water barrier that prevents water intrusion into the electric insulation. Particularly the invention relates to a medium or high-voltage electric cable.

BACKGROUND ART

Electric dynamic sea cables are electric power cables that may be connected to an off-shore installation. Off-shore installations may include floating platforms, platforms standing on the sea bottom, as well as floating vessels. Platforms are, for example, platforms by means of which oil and/or gas is exploited from sub-sea wells.

The electric power cables will typically be used to transmit electric power of medium or high voltage. In this description and the following claims "medium voltages" refers to voltages from about 1 kV up to about 40 kV, and "high voltages" refers to voltages from about 40 kV up to 800 kV or even above that figure.

A dynamic sea cable may be freely extending in the sea water between certain fixing points, for example the platform and the sea bottom and will therefore be moving with the motion of the sea, including sea currents and wind-induced motions. It is to be understood that part of an dynamic electric power sea cable can be located above the water level at the connection point to, for example, the platform or vessel.

A medium or high voltage three phase sea cable comprising three parallel conductors, each conductor surrounded with insulation and an outer protective sheath, behaves stiff only when bent a little. The protective sheath is usually made of metal and is also called a water barrier layer. Radially outside the outer protective sheath and also a part of the cable core a polymer layer could be arranged as protection. The insulation is, for example, polymer insulation, such as cross-linked polyethylene, or oil and paper insulation. "Cable core" will in the following description and claims refer to a conductor surrounded by insulation, the protective sheath and optional polymer layer.

All materials, but specifically the metals, in such a cable are exposed to mechanical fatigue due to the movements described above. Certain materials present lower fatigue strength and will therefore possibly crack if subjected to a certain degree of fatigue strain. Especially the water barrier layer, which usually is made of metal such as lead, copper or steel, is sensitive to fatigue and will eventually crack after too many or too large movements. This might lead to water ingress into the cable insulation which in turn might lead to a decrease in the electric properties of named insulation. An electric dynamic sea cable should therefore have a design that diminishes the forces acting on the internal parts of the cable, such as the water barrier layer.

SUMMARY OF THE INVENTION

An object of the invention is to provide an electric power sea cable that has improved resistance against bending forces acting on the cable.

According to a first aspect of the invention this object is obtained by an electric power sea cable. Advantageous embodiments of the invention will be clear from the description below.

According to one embodiment of the invention the electric power sea cable comprises at least one cable core, the cable core comprises an electric conductor, an electric insulation surrounding the conductor, and a protective sheath surrounding the electric insulation and acting as a water barrier preventing water intrusion into the electric insulation, the cable comprises at least one outer layer surrounding the at least one cable core. The water barrier is made of metal and the electric power cable comprises at least one friction reducing layer surrounding the at least one cable core and the friction reducing layer is arranged inside of the at least one outer layer. The friction reducing layer is adapted to prevent bending forces acting on the cable from being transmitted to the protective sheath of metal. Therewith a cable with improved resistance against bending will be obtained. Bending acting on the cable will induce bending, axial and friction stresses in the cable. Particularly the bending acting on the cable is prevented from being transmitted to the protective sheath arranged around the insulation and the risk that the protective sheath will crack is reduced. The outer layer may comprise several layers such as armoring and an outer jacket to protect the cable core mechanically.

According to one embodiment the protective sheath is made of a corrugated metallic sheath. The metallic sheath is formed into a tube which is welded along the longitudinal direction of the tube, and is arranged to enclose the at least one cable core, such that a totally water-impermeable protective sheath is formed. The corrugation is arranged with its waves helically or annularly in the circumferential direction of the tube made of the metallic protective sheath. The metal in the protective sheath is preferably a copper or aluminum alloy.

According to one embodiment of the invention the friction reducing layer is at least partly arranged between the protective sheath of the at least one cable core and the at least one outer layer. By arranging a friction reducing layer at least partly between the at least one outer layer and the protective sheath of the cable core a cable with improved resistance against bending will be obtained.

According to one embodiment the electrical power cable comprises three parallel cable cores, a so-called three phase cable, and the friction reducing layer surrounds the three cable cores. The friction reducing layer is arranged between the at least one outer layer and the protective sheaths of the conductors. By arranging the friction reducing layer between the outer layers and the protective sheaths the bending forces acting on the protective sheath are limited and the risk that the protective sheaths acting as a water barrier will crack is reduced.

According to one embodiment filler profiles are arranged in the space between the cable cores when the cable comprises two or more cores to build up a circular cross-section of the cable and to avoid, for example, a three phase cable with a triangular cross-section. Circular cables are easier to handle in cable production and during installation. According to one embodiment of the invention the friction reducing layer is also in contact with at least the part of the filler profiles facing the outer layers of the cable.

According to one embodiment the outer layers of the cable comprises a cable core binder surrounding the at least one cable core and the friction reducing layer is arranged radially inside the cable core binder. The cable core binder is, for example, wound around the cable cores and profiles, and holds the different cable parts. The friction reducing layer is arranged in contact with the cable core binder and at least partly in contact with the protective sheaths of the conductors.

According to an alternative embodiment to the above described embodiment a polymer layer is surrounding the protective sheath of the at least one cable core. The polymer layer is generally an extruded layer. The friction reducing layer arranged inside the cable core binder is then at least partly in contact with the polymer layer surrounding the protective sheath.

According to a further alternative embodiment to the above described embodiment, the friction reducing layer is arranged radially outside and in contact with the cable core binder. The friction reducing layer is arranged between the cable core binder and the at least one outer layer.

According to yet a further alternative embodiment to the above described embodiments, the friction reducing layer is arranged partly inside and partly outside the cable core binder. This is, for example, achieved by an overlap of a tape forming the cable core binder and a tape forming the friction reducing layer. The tape forming the cable core binder and the tape forming the friction reducing layer is wound at the same time and is overlapping each other.

According to one embodiment the cable comprises three parallel cable cores and the friction reducing layer is arranged radially outside each cable core, such that the inside of the friction reducing layer is in contact with the outer surface of the cable core. The outer surface of the cable core is either the protective sheath or the outer polymer layer of the cable core.

According to one embodiment at least the inner surface of the friction reducing layer has a friction coefficient in the interval 0.05-0.4, and preferably in the interval 0.1-0.3. The inner surface of the friction reducing layer is facing the protective sheaths, or the outer polymer layer arranged outside the protective sheath, or the cable core binder. This friction coefficient ensures that the bending forces acting on the cable are not transferred to the protective sheaths acting as a water barrier.

According to one embodiment the outer surface of the friction reducing layer has a friction coefficient in the interval 0.05-0.4, and preferably in the interval 0.1-0.3. The outer surface of the friction reducing layer is facing the cable core binder or the at least one outer layer. Therewith it is ensured that the bending forces acting on the cable are not transferred to the protective sheaths acting as a water barrier.

According to one embodiment the friction reducing layer comprises a polymer as the main constituent. According to one embodiment the polymer comprises at least one of the following polymers: polypropylene, high density polyethylene (HDPE), Teflon, silicone or polyester, such as for example Mylar®.

According to one embodiment the friction reducing layer has a thickness in the interval 0.01-1 mm, preferably 0.05-0.3 mm.

According to one embodiment the friction reducing layer is a wound layer of polymer tape. The layer is, for example, wound around the at least one cable core in a process step before the at least one outer layer or cable core binder is arranged around the conductors.

According to one embodiment the friction reducing layer is an extruded tubular polymer layer.

According to one embodiment the friction reducing layer comprises one of the following as a main constituent: a liquid, such as oil, graphite, grease or a wax.

According to one embodiment the cable is a dynamic sea-cable for connecting, for example, power cables to floating oil platforms in the sea. The insulation around the conductor of the cable cores is, for example, extruded cross-linked polyethylene or a paper and oil insulation.

According to a second aspect of the invention the object of the invention is provided by a an off-shore installation comprising an electric power cable extending freely in the sea between two fixing points, and where the electric power cable is an electric power sea cable. By providing an off-shore installation with an electrical power cable, a cable installation that is able to handle movements of the cable due to, for example, sea currents and waves, is obtained. The cable therewith has an increased resistance to mechanical fatigue compared to a cable without a friction reducing layer.

According to a third aspect of the invention the object of the invention is provided by the use of an electric power sea cable in an off-shore installation.

BRIEF DESCRIPTION OF THE DRAWING

The invention will be described in greater detail by description of embodiments with reference to the accompanying drawings, wherein.

DESCRIPTION OF PREFERRED EMBODIMENTS

Figure 1:
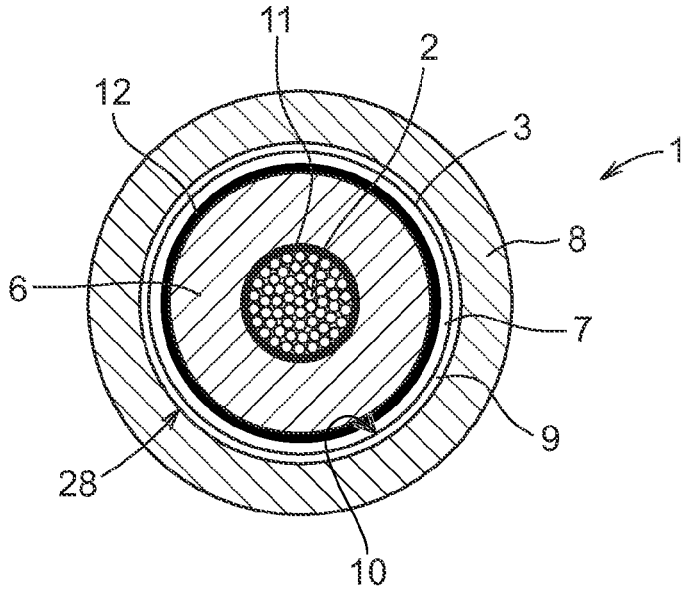
FIG. 1 is a radial cross section of a single-phase electric power sea cable according to one embodiment of the invention.

FIG. 1 shows a cross section of an electric power sea cable 1, comprising one single-conductor cable core 3 comprising an electrical conductor 2, and an electric insulation 6 of polymer surrounding the conductor 2. An inner conducting layer 11 is arranged between the conductor 2 and the electric insulation 6, and an outer conducting layer 12 is arranged outside and in contact with the insulation 6. A protective sheath 7 surrounds the outer conducting layer 12 and acts as a water barrier that prevents water intrusion into the electric insulation 6, and one outer layer 8 is arranged around the protective sheath 7. The outer layer 8 may comprises several layers such as armoring (not shown) and an outer jacket (not shown) to protect the cable core 3 mechanically. A friction reducing layer 9 is arranged inside of the outer layer 8 and at least partly in contact with the protective sheath 7. The friction reducing layer 9 is made of polypropylene, and has a thickness in the interval 0.05-0.3 mm. The inner surface 10 of the friction reducing layer 9 has a friction coefficient in the interval 0.1-0.38.

According to one alternative embodiment to the embodiment shown in FIG. 1 an extruded polymer layer (not shown) is arranged around the protective sheath 7 and the friction reducing layer 9 is arranged outside and at least partly in contact with the extruded polymer sheath.

Figure 2:
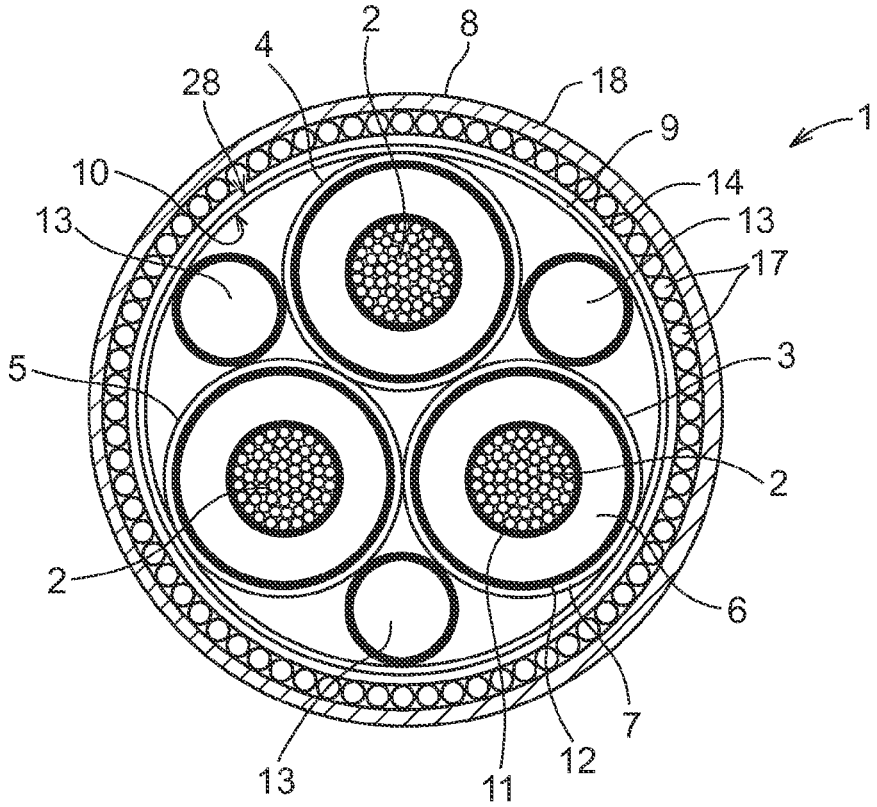
FIG. 2 is a radial cross section of a three-phase electric power sea cable according to one embodiment of the invention.

FIG. 2 shows a three-phase electric power cable 1 comprising three single-conductor cable cores 3, 4, 5. Each of the single-conductor cable cores 3, 4, 5 comprises a centre conductor 2 enclosed in an electric insulation layer 6 of polymer. An inner conducting layer 11 is arranged between the conductor 2 and the electric insulation 6 and an outer conducting layer 12 is arranged outside the insulation 6. A protective sheath 7 surrounds the outer conducting layer 12 and acts as a water barrier that prevents water intrusion into the electric insulation 6 of the cable core 3, 4, 5. The friction reducing layer 9 surrounds the three cable cores and is at least partly in contact with the outer surface of the cable cores 3, 4, 5. The outer surface of the cable core may be either the outer surface of the protective sheath 7 as in FIG. 3 or a polymer sheath (not shown) arranged around the protective sheath 7. Between the three cable cores 3, 4, 5 profiles 13, such as filler ropes or extruded profiles, are arranged. In FIG. 2 the friction reducing layer 9 is also in contact with at least part of the profiles 13. By arranging the friction reducing layer in contact with the outer layer of the cable cores 3, 4, 5 the bending forces acting on the protective sheath are limited and the risk that the protective sheaths acting as a water barrier will crack is reduced. The friction reducing layer 9 in this embodiment is a polymer tape, such as a polypropylene tape that is wound around the three cable cores. At least one outer layer 8 comprising, for example, armouring 17 and an outer jacket 18, surrounds the protective sheath 7 of the three conductors 2. A cable core binder 14 is arranged between the outer layers and the friction reducing layer 9. The cable core binder 14 is usually wound around the cable cores 3, 4, 5 and profiles 13 and holds the cable cores and profiles together.

Figure 3:
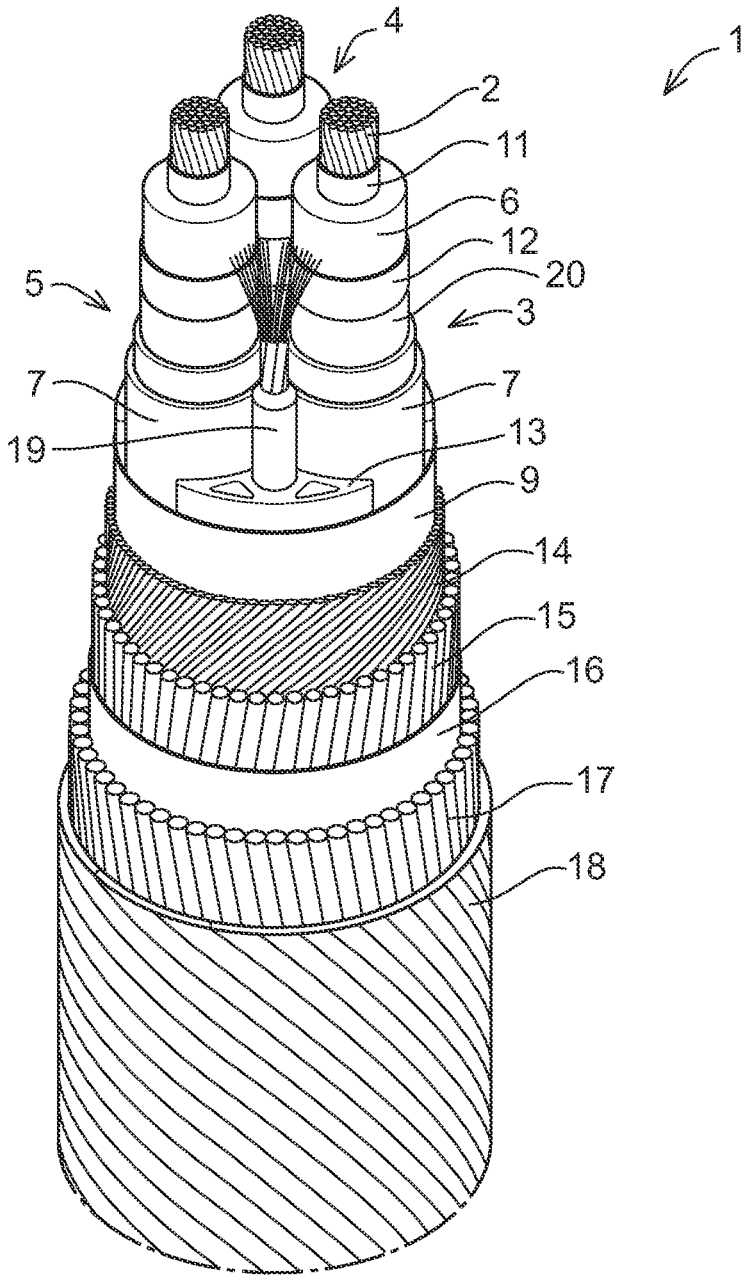
FIG. 3 is a three-phase electric power sea cable according to one embodiment of the invention.

FIG. 3 schematically shows the three-phase cable 1 in FIG. 2 with additional outer layers and profiles that are usually a part of a three phase power cable. An inner conducting layer 11 is arranged between the conductor 2 and the electrical insulation 6 and an outer conducting layer 12 is arranged outside the insulation 6. The cable core 3, 4, 5 comprises also a cable core armouring layer 20 outside the outer conducting layer 12. The at least one outer layer 8 of the power cable 1 comprises several layers 15-18, such as armouring wires 15, 17 and an outer jacket 18 to protect the cable cores and hold them and the filler profiles together. Filler profiles 13 are arranged in the space between the cable cores 3, 4, 5 to build up a circular cross-section of the cable. In one of the filler profiles in FIG. 3 optical fibres 19 are embedded.

In FIG. 3 the friction reducing layer 9 is arranged on the inside of the cable core binder 14 such that the friction reducing layer 9 is in contact with at least a part of the protective sheaths 7 facing the cable core binder 14. In FIG. 3 the friction reducing layer 9 is also in contact with part of the surface of the filler profiles 13.

Figure 4:
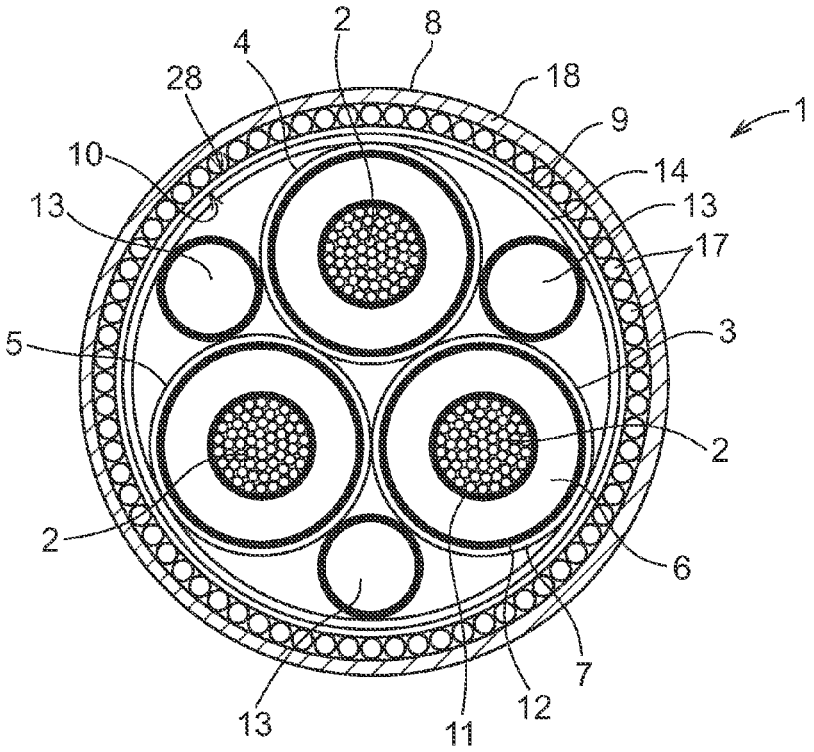
FIG. 4 is a radial cross section of a three-phase electric power sea cable according to an alternative embodiment of the invention.

FIG. 4 shows an alternative embodiment to the embodiment in FIG. 2, where the friction reducing layer 9 is arranged between the at least one outer layer 8 and the cable core binder 14, i.e. the friction reducing layer 9 is arranged radially outside and in contact with the cable core binder 14. The friction reducing layer is a polymer tape that is wound around the cable core binder 14.

Figure 5:
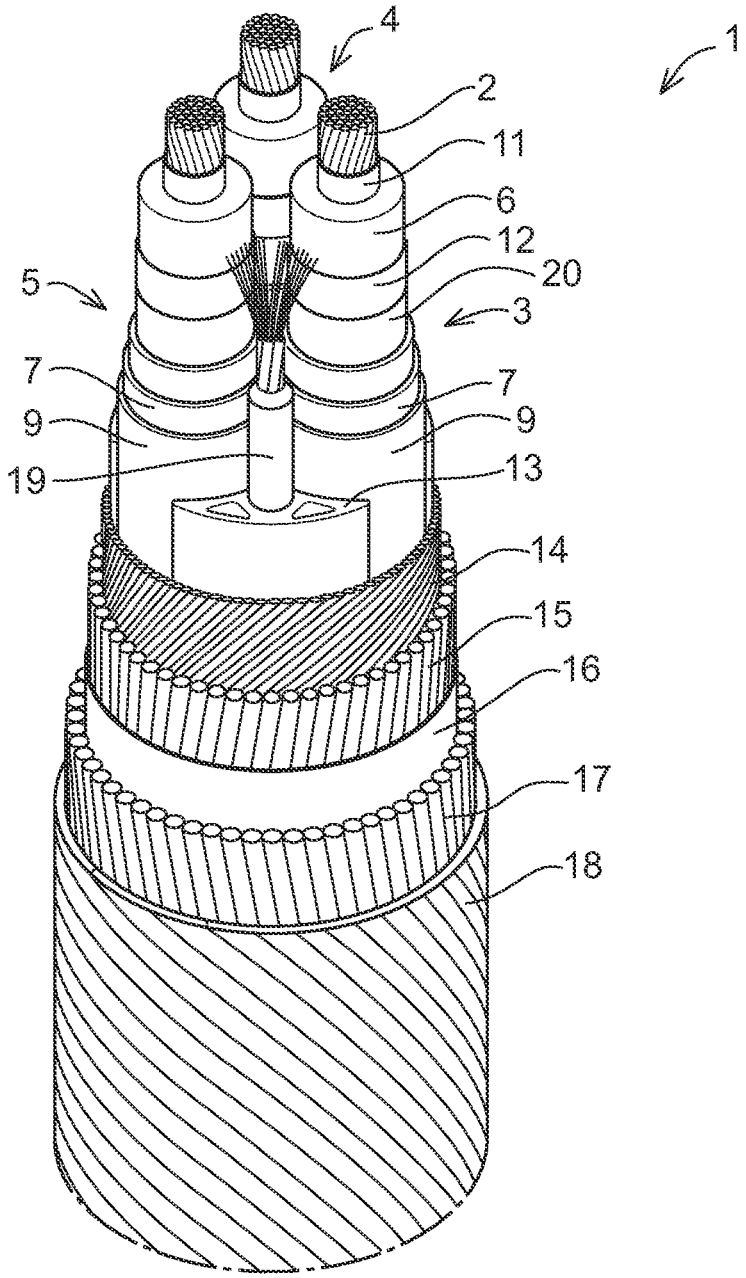
FIG. 5 is a three-phase electric power sea cable according to an alternative embodiment of the cable in FIG. 1, and FIG. 6 schematically shows an off-shore installation comprising an electric dynamic power sea cable extending freely in the sea between two fixing points.

FIG. 5 shows an alternative embodiment to the embodiment in FIG. 1, where the electric power cable comprises three parallel cable cores 3, 4, 5. The friction reducing layer 9 is arranged radially outside each cable core, such that the inside of the friction reducing layer is in contact with the outer surface of the cable cores. The outer surface of the cable core is either the metallic protective sheath 7 or an outer polymer layer (not shown) of the cable core.

Figure 6:
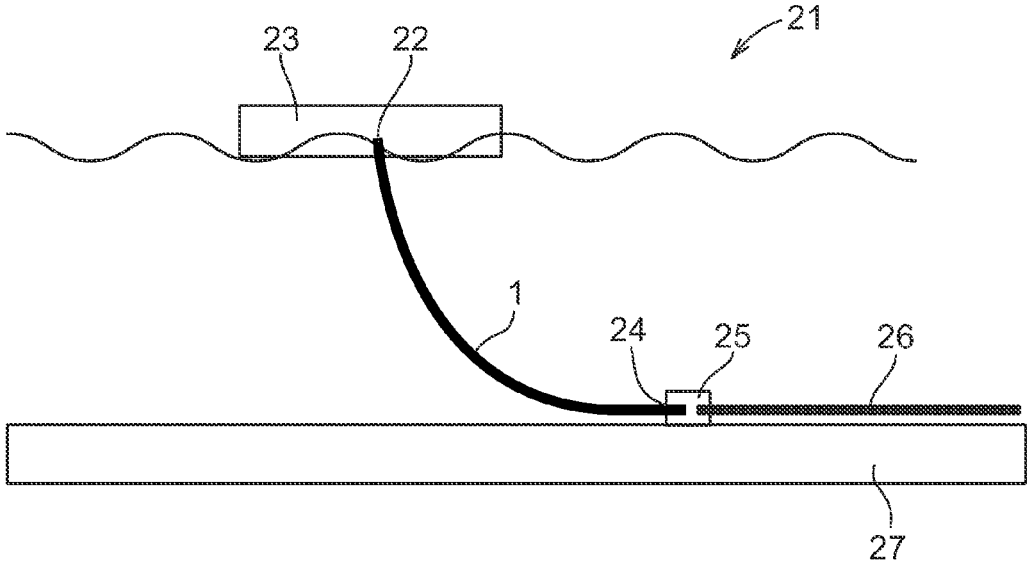

FIG. 6 schematically shows a floating off-shore installation 21 comprising a dynamic electric power cable 1 according to any of the above described embodiments. The power cable 1 is extending freely in the sea between two fixing points. The first fixing point 22 is where a first end of the dynamic power cable 1 is connected to a floating platform 23 and the second fixing point 24 is where a second end of the dynamic power cable 1 is connected to a sub sea installation 25. A second power cable 26 arranged on the sea bed 27 is connected to the sub sea installation 25. The sub sea installation 25 is, for example, a transition joint or some type of sub sea station. The dynamic power cable 1 may instead of being connected to a sub sea installation 25 connect two floating platforms 23.

The three phase cable behaves stiff even if the cable is only bent a little. All layers stick to each other due to the friction between the different layers. In case the friction between the layers is high, the high level of bending stiffness is kept even when bending more. When bending still more the layers start to slide along each other, i.e. the friction between the layers can not keep the layers to stick to each other this results in lower bending stiffness. A low bending gives a high bending stiffness and a high bending gives a low bending stiffness. The transition point between these two levels of bending stiffness depends on the level of friction between the different layers in the cable.

With high bending stiffness the bending forces acting on the cable are transmitted to the individual layers. As a result the layers are stressed hard. With low bending stiffness these forces are limited. The friction reducing layer 9 reduces the bending stiffness of the cable and therewith the bending forces acting on the protective sheath 7.

The protective sheaths are metallic and made of, for example, steel, cupper or lead.

The time to failure for a three phase dynamic sub sea cable with and without a friction reducing layer has been calculated for different positions along the cable. For the cable without a friction reducing layer the friction coefficient was 0.44 between the cable core binder and the cable cores. For the dynamic cable comprising a friction reducing layer between the at least one outer layer and the cable cores the friction coefficient of the friction reducing layer was 0.2. For example, the calculated time to failure for the protective sheath at the position where the dynamic sub sea is connected to the floating platform was 36 years with a friction coefficient of 0.2, and 7 years with a friction coefficient of 0.44, i.e. the friction reducing layer increased the calculated lifetime with a factor 5. At the position where the dynamic sub sea cable is close to the seabed the calculated lifetime of the protective sheath increased from 3400 years to 4200 years when the friction coefficient was reduced. In positions between the top and bottom the calculated lifetime of the protective sheath increases from 9300 to 11 000 years when the friction coefficient is reduced from 0.44 to 0.2.

The invention is not in any way limited to the preferred embodiments described above. On the contrary, several possibilities to modifications thereof should be evident to a person skilled in the art, without deviating from the basic idea of the invention as defined in the appended claims. For example the cables parts and layers in the above described embodiments could be arranged in a different way, all the mentioned layers may not be necessary or there could also be additional layers that are not described. Also, when a tape forms the cable core binder and a tape forms the friction reducing layer, they may be overlapping each other, such that the friction reducing layer is arranged both inside and outside the cable core binder.

The invention claimed is:

1. An electric power dynamic sea cable (1), comprising:

at least one cable core (3) comprising a conductor (2), an electric insulation (6) surrounding the conductor (2), and a water barrier comprising a protective sheath (7) surrounding the electric insulation (6), at least one outer layer (8) surrounding the at least one cable core (3), and at least one friction reducing layer (9) surrounding the at least one cable core (3), wherein the at least one friction reducing layer (9) comprises a wound layer of a polymer tape, at least one surface (10) of the at least one friction reducing layer (9) has a friction coefficient in an interval of 0.1-0.3, the at least one friction reducing layer (9) is at least partially arranged between the water barrier (7) and the at least one outer layer (8), the at least one friction reducing layer (9) and the at least one outer layer (8) are not bonded or interlocked with one another, and the at least one friction reducing layer (9) and the water barrier (7) are not bonded or interlocked with one another, such that sliding movement between the water barrier (7) and the at least one outer layer (8) occurs upon bending of the cable (1) beyond a threshold and prevents transferring bending force of the at least one outer layer (8) to the water barrier (7).

2. The electric power dynamic sea cable according to claim 1, wherein the water barrier comprises a corrugated metallic sheath.

3. The electric power dynamic sea cable according to claim 1, wherein the at least one friction reducing layer is completely arranged between the water barrier of the at least one cable core and the at least one outer layer.

4. The electric power dynamic sea cable according to claim 1, wherein the at least one cable core comprises three parallel cable cores and the friction reducing layer surrounds the three cable cores.

5. The electric power dynamic sea cable according to claim 1, further comprising:

a cable core binder surrounding the at least one cable core, wherein the friction reducing layer is arranged radially outside the cable core binder.

6. The electric power dynamic sea cable according to claim 1, wherein the at least one cable core comprises three parallel cable cores and wherein the friction reducing layer is arranged radially outside each cable core.

7. The electric power dynamic sea cable according to claim 1, wherein the polymer tape comprises at least one of the following: polypropylene, high density polyethylene, Teflon, silicone or polyester.

8. The electric power dynamic sea cable according to claim 1, wherein the friction reducing layer has a thickness in an interval 0.01-1 mm.

9. The electric power dynamic sea cable according to claim 8, wherein the friction reducing layer has a thickness in an interval 0.05-0.3 mm.

10. The electric power dynamic sea cable according to claim 1, wherein the polymer tape is an extruded tape.

11. The electric power dynamic sea cable according to claim 1, wherein the at least one cable core further comprises an inner conducting layer arranged between the conductor and the electric insulation and an outer conducting layer outside the electric insulation.

12. The electric power dynamic sea cable according to claim 1, wherein the electric power dynamic sea cable comprises a plurality of cable cores, the electric power dynamic sea cable further comprising:

an outer friction reducing layer surrounding all of the cable cores;

a binder layer surrounding the outer friction reducing layer;

an armor layer surrounding the binder layer; and an outer jacket surrounding the armor layer.

13. An off-shore installation (21) comprising:

an electric power dynamic sea cable (1) extending freely in the sea between two fixing points (22, 23), wherein the electric power dynamic sea cable (1) comprises at least one cable core (3) comprising a conductor (2), an electric insulation (6) surrounding the conductor (2), and a water barrier comprising a protective sheath (7) surrounding the electric insulation (6), at least one outer layer (8) surrounding the at least one cable core (3), and at least one friction reducing layer (9) surrounding the at least one cable core (3), wherein the at least one friction reducing layer (9) comprises a wound layer of a polymer tape, at least one surface (10) of the at least one friction reducing layer (9) has a friction coefficient in an interval of 0.1-0.3, the at least one friction reducing layer (9) is at least partially arranged between the water barrier (7) and the at least one outer layer (8), the at least one friction reducing layer (9) and the at least one outer layer (8) are not bonded or interlocked with one another, and the at least one friction reducing layer (9) and the water barrier (7) are not bonded or interlocked with one another, such that sliding movement between the water barrier (7) and the at least one outer layer (8) occurs upon bending of the cable (1) beyond a threshold and prevents transferring bending force of the at least one outer layer (8) to the water barrier (7).

14. A method for transmitting electric power to an off-shore installation (21), the method comprising:

extending an electric power dynamic sea cable (1) in the sea between two fixing points (22, 24), wherein the electric power dynamic sea cable (1) comprises at least one cable core (3) comprising a conductor (2), an electric insulation (6) surrounding the conductor (2), and a water barrier comprising a protective sheath (7) surrounding the electric insulation (6), at least one outer layer (8) surrounding the at least one cable core (3), and at least one friction reducing layer (9) surrounding the at least one cable care (3), wherein the at least one friction reducing layer (9) comprises a wound layer of a polymer tape, at least one surface (10) of the at least one friction reducing layer 9) has a friction coefficient in an interval of 0.1-0.3, the at least one friction reducing layer (9) is at least partially arranged between the water barrier (7) and the at least one outer layer (8), the at least one friction reducing layer (9) and the at least one outer layer (8) are not bonded or interlocked with one another, and the at least one friction reducing layer (9) and the water barrier (7) are not bonded or interlocked with one another, such that sliding movement between the water barrier (7) and the at least one outer layer (8) occurs upon bending of the cable (1) beyond a threshold and prevents transferring bending force of the at least one outer layer (8) to the water barrier (7).

15. An electric power dynamic sea cable (1), comprising:

three cable cores (3, 4, 5), each said cable, core (3, 4, 5) comprising a conductor (2), an electric insulation (6) surrounding the conductor (2), and a water barrier comprising a protective, sheath (7) surrounding the electric insulation (6), an outer friction reducing layer (9) surrounding said three cable cores (3, 4, 5), a binder layer (14) surrounding the outer friction reducing layer (9), an armor layer (17) surrounding the binder layer (14), an outer jacket (18) surrounding the armor layer (17), and filler profiles (13) arranged between said three cable cores (3, 4, 5), with the outer friction reducing layer (9) also surrounding the filler profiles (13), wherein the outer friction reducing layer (9) comprises a wound layer of a polymer tape, at least one surface (10) of the at least one friction reducing layer (9) has a friction coefficient in an interval of 0.1-0.3, and the outer friction reducing layer (9) is at least partially arranged between the water barrier (7) and the binder layer (14).

* * * * *